US010247464B2

(12) United States Patent
Barito et al.

(10) Patent No.: US 10,247,464 B2
(45) Date of Patent: Apr. 2, 2019

(54) SEALED SYSTEM FOR AN APPLIANCE

(71) Applicant: General Electric Company, Schenectady, NY (US)

(72) Inventors: Thomas Robert Barito, Louisville, KY (US); Gregory William Hahn, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 359 days.

(21) Appl. No.: 15/007,341

(22) Filed: Jan. 27, 2016

(65) Prior Publication Data

US 2017/0211869 A1 Jul. 27, 2017

(51) Int. Cl.

| | |
|---|---|
| ***F04B 39/02*** | (2006.01) |
| ***F04B 39/06*** | (2006.01) |
| ***F04B 39/12*** | (2006.01) |
| ***F25D 17/06*** | (2006.01) |

(52) U.S. Cl.

CPC ..... *F25D 17/062* (2013.01); *F04B 39/02* (2013.01); *F04B 39/023* (2013.01); *F04B 39/06* (2013.01); *F04B 39/121* (2013.01)

(58) Field of Classification Search

CPC ..... F04B 39/06; F25B 31/02; F25B 31/004; F25B 31/002; F25B 2400/24

See application file for complete search history.

(56) References Cited

U.S. PATENT DOCUMENTS

| | | | | |
|---|---|---|---|---|
| 2,963,216 | A * | 12/1960 | Heitchue, Sr. | F25B 31/02 310/54 |
| 4,569,645 | A | 2/1986 | Asami et al. | |
| 2011/0203538 | A1* | 8/2011 | Menier | B60H 1/00828 123/41.11 |
| 2017/0016651 | A1* | 1/2017 | Lee | F25B 1/047 |

FOREIGN PATENT DOCUMENTS

| | | | |
|---|---|---|---|
| EP | 0976993 | A2 | 2/2000 |
| JP | S55123391 | A | 9/1980 |

* cited by examiner

*Primary Examiner* — Elizabeth J Martin

(74) *Attorney, Agent, or Firm* — Dority & Manning, P.A.

(57) ABSTRACT

A sealed system for an appliance includes a compressor having a shell and lubrication oil disposed with the shell. A condenser in fluid communication with the compressor such that compressed refrigerant from the compressor flows to the condenser during operation of the compressor. The sealed system also includes a heat exchanger for cooling the lubrication oil during operation of the compressor.

9 Claims, 6 Drawing Sheets

SEALED SYSTEM FOR AN APPLIANCE

FIELD OF THE INVENTION

The present subject matter relates generally to sealed systems for appliances, such as refrigerator appliances.

BACKGROUND OF THE INVENTION

Certain refrigerator appliances include sealed systems for cooling chilled chambers of the refrigerator appliance. The sealed systems generally include a compressor that generates compressed refrigerant during operation of the sealed system. The compressed refrigerant flows to an evaporator where heat exchange between the chilled chambers and the refrigerant cools the chilled chambers and food items located therein.

Recently, certain refrigerator appliances have included linear compressors for compressing refrigerant. Linear compressors generally include a piston and a driving coil. The driving coil generates a force for sliding the piston forward and backward within a chamber. During motion of the piston within the chamber, the piston compresses refrigerant. However, friction between the piston and a wall of the chamber can negatively affect operation of the linear compressors if the piston is not suitably aligned within the chamber. In particular, friction losses due to rubbing of the piston against the wall of the chamber can negatively affect an efficiency of an associated refrigerator appliance. Such friction can also reduce heat lubricating oil between the piston and the wall of the chamber and thereby reduce an effectiveness of the lubricating oil.

Accordingly, a linear compressor with features for limiting friction and/or contact between a piston and a wall of a cylinder during operation of the linear compressor would be useful. In addition, a linear compressor with features for cooling lubricating oil of the linear compressor would be useful.

BRIEF DESCRIPTION OF THE INVENTION

The present subject matter provides a sealed system for an appliance. The sealed system includes a compressor having a shell and lubrication oil disposed with the shell. A condenser in fluid communication with the compressor such that compressed refrigerant from the compressor flows to the condenser during operation of the compressor. The sealed system also includes a heat exchanger for cooling the lubrication oil during operation of the compressor. Additional aspects and advantages of the invention will be set forth in part in the following description, or may be apparent from the description, or may be learned through practice of the invention.

In a first exemplary embodiment, a sealed system for an appliance is provided. The sealed system includes a compressor having a shell and a lubrication oil disposed with the shell. A condenser is in fluid communication with the compressor such that compressed refrigerant from the compressor flows to the condenser during operation of the compressor. A condenser fan is configured for selectively urging a flow of air across the condenser. A heat exchanger is positioned adjacent the condenser fan. The heat exchanger is in fluid communication with the compressor such that lubrication oil from the compressor flows to the heat exchanger during operation of the compressor.

In a second exemplary embodiment, a sealed system for an appliance is provided. The sealed system includes a compressor having a shell and a lubrication oil disposed with the shell. A condenser is in fluid communication with the compressor such that compressed refrigerant from the compressor flows to the condenser during operation of the compressor. A heat exchanger is positioned on a portion of the condenser. The heat exchanger is in fluid communication with the compressor such that lubrication oil from the compressor flows to the heat exchanger during operation of the compressor.

In a third exemplary embodiment, a sealed system for an appliance is provided. The sealed system includes a compressor having a shell and a lubrication oil disposed with the shell. A condenser is in fluid communication with the compressor such that compressed refrigerant from the compressor flows to the condenser during operation of the compressor. A heat exchanger is positioned within the shell of the compressor. A refrigeration conduit extends from the condenser to the heat exchanger such that the refrigeration conduit directs refrigerant from the condenser to the heat exchanger during operation of the compressor.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
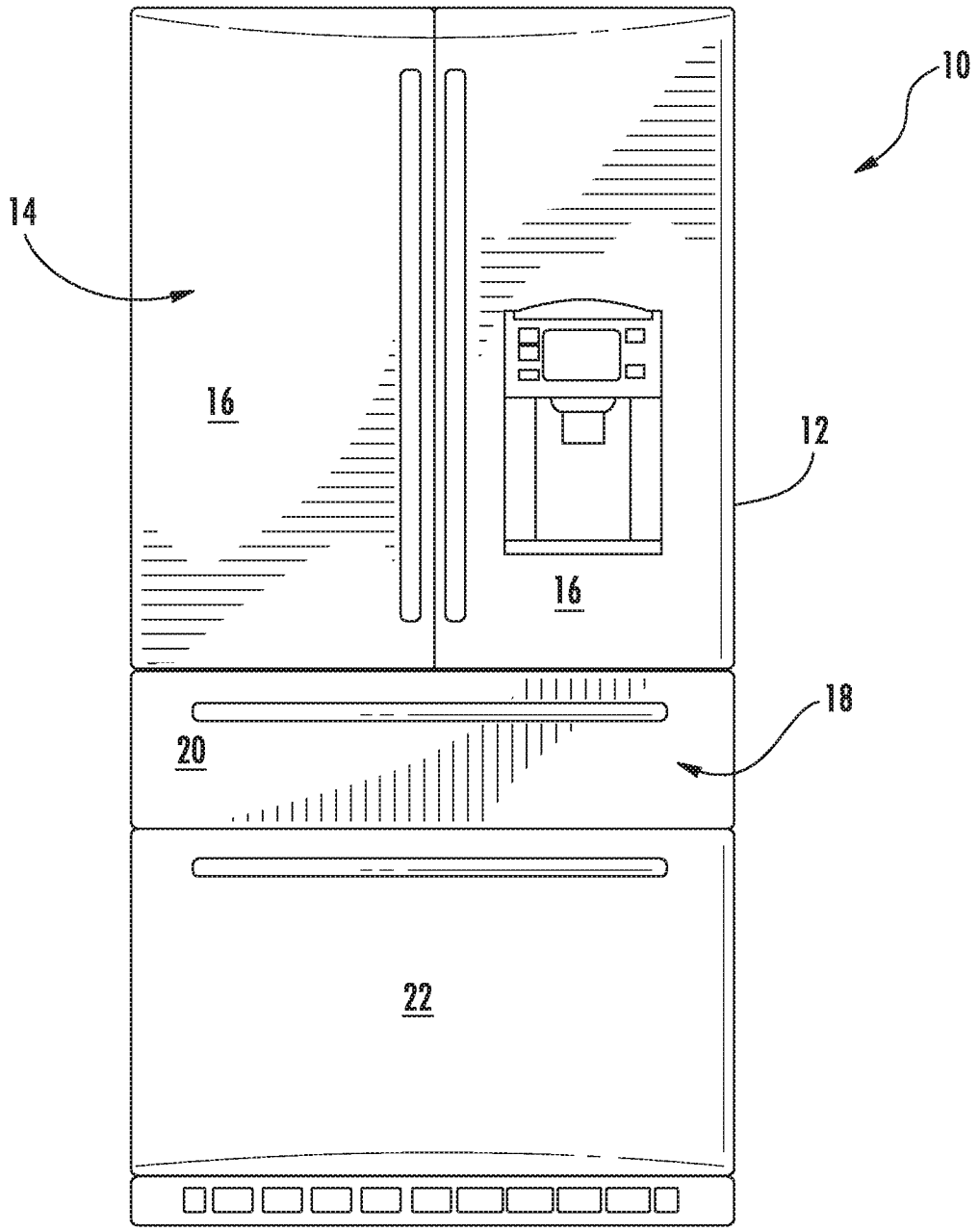
FIG. 1 is a front elevation view of a refrigerator appliance according to an exemplary embodiment of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
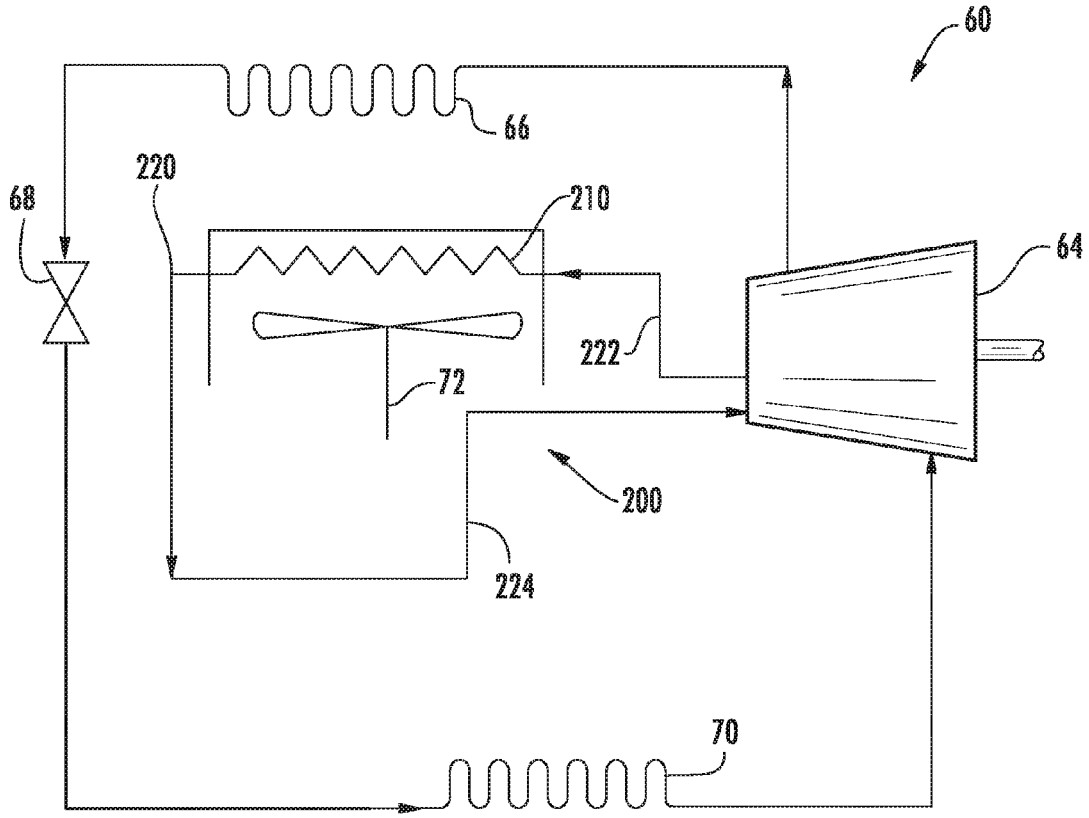
FIGS. 2, 3 and 6 are schematic views of certain components of the exemplary refrigerator appliance of FIG. 1 with respective exemplary oil cooling circuits according exemplary embodiments of the present subject matter.

FIG. 1 depicts a refrigerator appliance 10 that incorporates a sealed refrigeration system 60 (FIG. 2). It should be appreciated that the term "refrigerator appliance" is used in a generic sense herein to encompass any manner of refrigeration appliance, such as a freezer, refrigerator/freezer combination, and any style or model of conventional refrigerator. In addition, it should be understood that the present subject matter is not limited to use in appliances. Thus, the present subject matter may be used for any other suitable purpose, such as vapor compression within air conditioning units or air compression within air compressors.

In the illustrated exemplary embodiment shown in FIG. 1, the refrigerator appliance 10 is depicted as an upright refrigerator having a cabinet or casing 12 that defines a number of internal chilled storage compartments. In particular, refrigerator appliance 10 includes upper fresh-food compartments 14 having doors 16 and lower freezer compartment 18 having upper drawer 20 and lower drawer 22. The drawers 20 and 22 are "pull-out" drawers in that they can be manually moved into and out of the freezer compartment 18 on suitable slide mechanisms.

Figure 3:
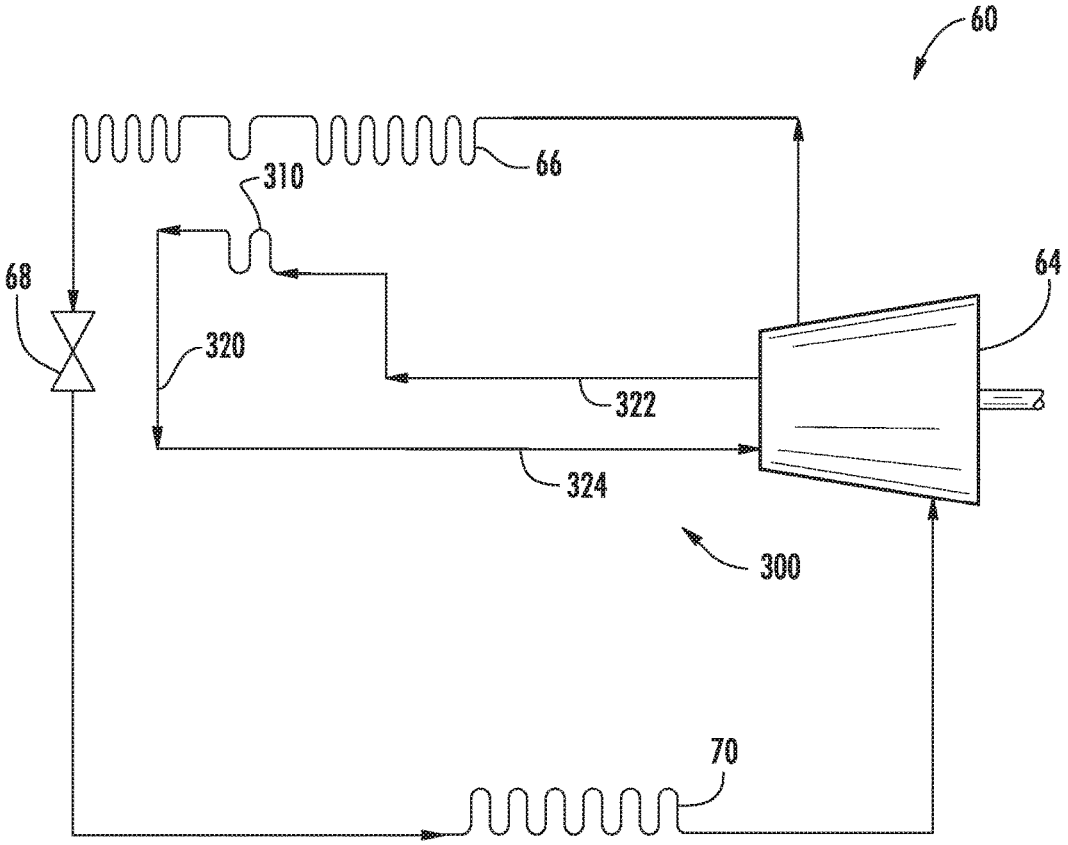
Figure 6:
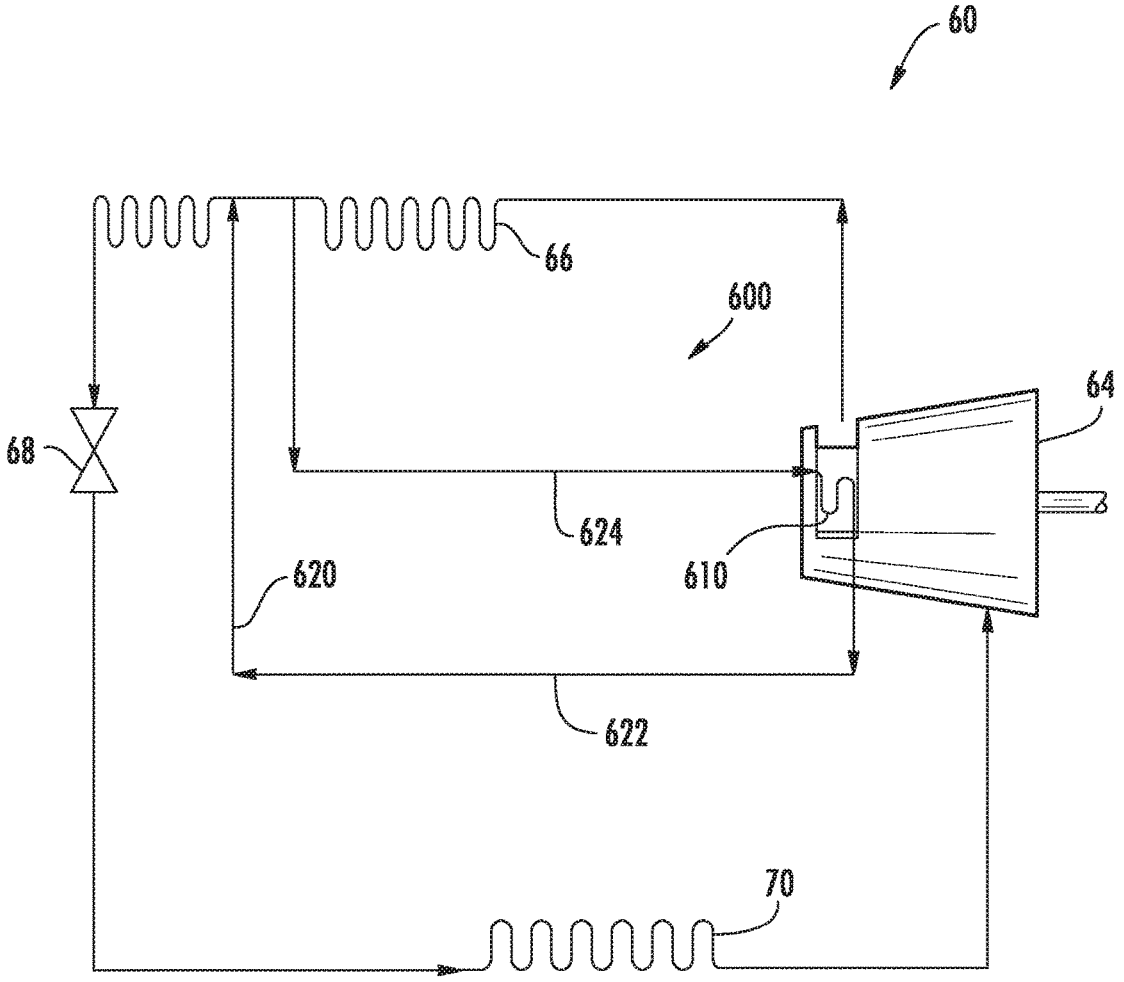

FIGS. 2, 3 and 6 are schematic views of certain components of refrigerator appliance 10, including a sealed refrigeration system 60 of refrigerator appliance 10. FIGS. 2, 3 and 6 each illustrate a respective exemplary oil cooling circuit according exemplary embodiments of the present subject matter. Refrigeration system 60 of refrigerator appliance 10 may be configured or equipped with any of the exemplary oil cooling circuits of FIGS. 2, 3 and 6. Thus, the exemplary oil cooling circuits of FIGS. 2, 3 and 6 are discussed in greater detail below in the context of refrigeration system 60 of refrigerator appliance 10. However, it should be understood that the exemplary oil cooling circuits of FIGS. 2, 3 and 6 may be used in or with any suitable appliance in alternative exemplary embodiments. For example, the exemplary oil cooling circuits of FIGS. 2, 3 and 6 may be used in or with heat pump dryer appliances, heat pump water heater appliance, air conditioner appliances, etc.

A machinery compartment of refrigerator appliance 10 may contain components for executing a known vapor compression cycle for cooling air. The components include a compressor 64, a condenser 66, an expansion device 68, and an evaporator 70 connected in series and charged with a refrigerant. As will be understood by those skilled in the art, refrigeration system 60 may include additional components, e.g., at least one additional evaporator, compressor, expansion device, and/or condenser. As an example, refrigeration system 60 may include two evaporators.

Within refrigeration system 60, refrigerant flows into compressor 64, which operates to increase the pressure of the refrigerant. This compression of the refrigerant raises its temperature, which is lowered by passing the refrigerant through condenser 66. Within condenser 66, heat exchange with ambient air takes place so as to cool the refrigerant. A condenser fan 72 is used to pull air across condenser 66 so as to provide forced convection for a more rapid and efficient heat exchange between the refrigerant within condenser 66 and the ambient air. Thus, as will be understood by those skilled in the art, increasing air flow across condenser 66 can, e.g., increase the efficiency of condenser 66 by improving cooling of the refrigerant contained therein.

An expansion device (e.g., a valve, capillary tube, or other restriction device) 68 receives refrigerant from condenser 66. From expansion device 68, the refrigerant enters evaporator 70. Upon exiting expansion device 68 and entering evaporator 70, the refrigerant drops in pressure. Due to the pressure drop and/or phase change of the refrigerant, evaporator 70 is cool relative to compartments 14 and 18 of refrigerator appliance 10. As such, cooled air is produced and refrigerates compartments 14 and 18 of refrigerator appliance 10. Thus, evaporator 70 is a type of heat exchanger which transfers heat from air passing over evaporator 70 to refrigerant flowing through evaporator 70.

Collectively, the vapor compression cycle components in a refrigeration circuit, associated fans, and associated compartments are sometimes referred to as a sealed refrigeration system operable to force cold air through compartments 14, 18 (FIG. 1). The refrigeration system 60 depicted in FIG. 2 is provided by way of example only. Thus, it is within the scope of the present subject matter for other configurations of the refrigeration system to be used as well.

Turning now to FIG. 2, an oil cooling circuit 200 according to an exemplary embodiment of the present subject matter is shown with refrigeration system 60. Compressor 64 of refrigeration system 60 may include a shell with a lubrication oil therein. The lubrication oil may assist with reducing friction between sliding or moving components of compressor 64 during operation of compressor 64. For example, the lubrication oil may reduce friction between a piston and a cylinder of compressor 64 when the piston slides within the cylinder to compress refrigerant, as discussed in greater detail below.

During operation of compressor 64, the lubrication oil may increase in temperature. Thus, oil cooling circuit 200 is provided to assist with rejecting heat from the lubrication oil. By cooling the lubrication oil, an efficiency of compressor 64 may be improved. Thus, oil cooling circuit 200 may assist with increasing the efficiency of compressor 64, e.g., relative to a compressor without oil cooling circuit 200, by reducing the temperature of the lubrication oil within compressor 64.

Oil cooling circuit 200 includes a heat exchanger 210 and a lubrication oil conduit 220. Lubrication oil conduit 220 extends between compressor 64 and heat exchanger 210. Lubrication oil from compressor 64 may flow to heat exchanger 210 via lubrication oil conduit 220. As shown in FIG. 2, lubrication oil conduit 220 may include a supply conduit 222 and a return conduit 224. Supply conduit 222 extends between compressor 64 and heat exchanger 210 and is configured for directing lubricating oil from compressor 64 to heat exchanger 210. Conversely, return conduit 224 extends between heat exchanger 210 and compressor 64 and is configured for directing lubricating oil from heat exchanger 210 to compressor 64.

Within heat exchanger 210, the lubrication oil may reject heat to ambient air about heat exchanger 210. From heat exchanger 210, the lubrication oil flows back to compressor 64 via lubrication oil conduit 220. In such a manner, lubrication oil conduit 220 may circulate lubrication oil between compressor 64 and heat exchanger 210, and heat exchanger 210 may reduce the temperature of lubricating oil from compressor 64 before returning the lubricating oil to compressor 64. Thus, oil cooling circuit 200 may remove lubrication oil from compressor 64 via lubrication oil conduit 220 and return the lubricating oil to compressor 64 via lubrication oil conduit 220 after cooling the lubricating oil in heat exchanger 210.

Heat exchanger 210 is positioned at or adjacent fan 72. In particular, heat exchanger 210 may be positioned and oriented such that fan 72 pulls or urges air across heat exchanger 210 so as to provide forced convection for a more rapid and efficient heat exchange between lubrication oil within heat exchanger 210 and ambient air about refrigeration system 60. In certain exemplary embodiments, heat exchanger 210 may be disposed between fan 72 and condenser 66. Thus, heat exchanger 210 may be disposed downstream of fan 72 and upstream of condenser 66 relative to a flow of air from fan 72, in certain exemplary embodiments. In such a manner, air from fan 72 may heat exchange with lubrication oil in heat exchanger 210 prior to heat exchange with refrigerant in condenser 66.

Turning now to FIG. 3, an oil cooling circuit 300 according to an exemplary embodiment of the present subject matter is shown with refrigeration system 60. Like oil cooling circuit 200 (FIG. 2), oil cooling circuit 300 may assist with rejecting heat from the lubrication oil in refrigeration system 60. Oil cooling circuit 300 includes a heat exchanger 310 and a lubrication oil conduit 320. Lubrication oil conduit 320 extends between compressor 64 and heat exchanger 310. Lubrication oil from compressor 64 may flow to heat exchanger 310 via lubrication oil conduit 320. As shown in FIG. 3, lubrication oil conduit 320 may include a supply conduit 322 and a return conduit 324. Supply conduit 322 extends between compressor 64 and heat exchanger 310 and is configured for directing lubricating oil from compressor 64 to heat exchanger 310. Conversely, return conduit 324 extends between heat exchanger 310 and compressor 64 and is configured for directing lubricating oil from heat exchanger 310 to compressor 64.

Within heat exchanger 310, the lubrication oil may reject heat to refrigerant within condenser 66. From heat exchanger 310, the lubrication oil flows back to compressor 64 via lubrication oil conduit 320. In such a manner, lubrication oil conduit 320 may circulate lubrication oil between compressor 64 and heat exchanger 310, and heat exchanger 310 may reduce the temperature of lubricating oil from compressor 64 before returning the lubricating oil to compressor 64. Thus, oil cooling circuit 300 may remove lubrication oil from compressor 64 via lubrication oil conduit 320 and return the lubricating oil to compressor 64 via lubrication oil conduit 320 after cooling the lubricating oil in heat exchanger 310.

Heat exchanger 310 is positioned at or on condenser 66. In particular, heat exchanger 310 may be mounted to condenser 66 such that heat exchanger 310 and condenser 66 are in conductive thermal communication with each other. Thus, condenser 66 and heat exchanger 310 may conductively exchange heat. In such a manner, heat exchanger 310 and condenser 66 may provide for heat exchange between lubrication oil within heat exchanger 310 and refrigerant within condenser 66. In certain exemplary embodiments, heat exchanger 310 may be a tube-to-tube heat exchanger integrated within or onto condenser 66, e.g., a portion of condenser 66. For example, heat exchanger 310 may be welded or soldered onto condenser 66.

Heat exchanger 310 may be disposed on a portion of condenser 66 between an inlet and an outlet of condenser 66. For example, refrigerant may enter condenser 66 at the inlet of condenser 66 at a first temperature (e.g., one hundred and fifty degrees Fahrenheit (150° F.)), and heat exchanger 310 may be positioned on condenser 66 downstream of the inlet of condenser 66 such that refrigerant immediately upstream of the portion of condenser 66 where heat exchanger 310 is mounted may have a second temperature (e.g., ninety degrees Fahrenheit (90° F.)). Heat exchanger 310 may also be positioned on condenser 66 upstream of the outlet of condenser 66 such that refrigerant immediately downstream of the portion of condenser 66 where heat exchanger 310 is mounted may have a third temperature (e.g., one hundred and five degrees Fahrenheit (105° F.)), and refrigerant may exit condenser 66 at the outlet of condenser 66 at a fourth temperature (e.g., ninety degrees Fahrenheit (90° F.)). Thus, refrigerant within condenser 66 may increase in temperature at the portion of condenser 66 where heat exchanger 310 is mounted during operation of compressor 64 in order to cool lubrication oil within heat exchanger 310. However, the portion of condenser 66 downstream of heat exchanger 310 may assist with rejecting heat to ambient air about condenser 66.

Figure 4:
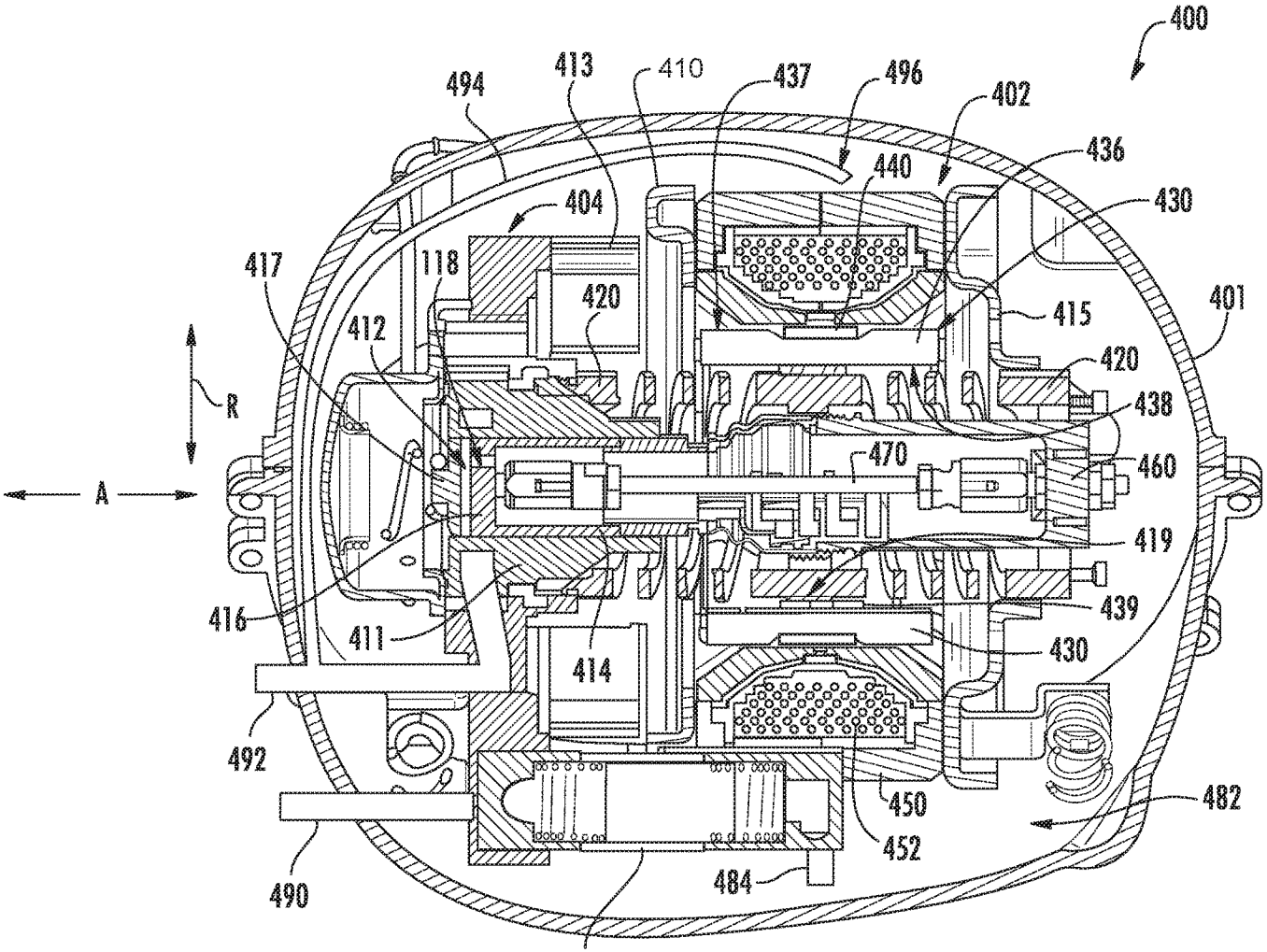
FIG. 4 provides a section view of an exemplary linear compressor with an oil flow path according to an exemplary embodiment of the present subject matter.

FIG. 4 provides a section view of a linear compressor 400 according to an exemplary embodiment of the present subject matter. As discussed in greater detail below, linear compressor 400 is operable to increase a pressure of fluid within a chamber 412 of linear compressor 400. Linear compressor 400 may be used to compress any suitable fluid, such as refrigerant. In particular, linear compressor 400 may be used in a refrigerator appliance, such as refrigerator appliance 10 (FIG. 1) in which linear compressor 400 may be used as compressor 64 (FIG. 2). As may be seen in FIG. 3, linear compressor 400 defines an axial direction A and a radial direction R. Linear compressor 400 may be enclosed within a hermetic or air-tight shell 401. Hermetic shell 401 hinders or prevents refrigerant and/or lubricating oil from leaking or escaping refrigeration system 60.

Linear compressor 400 includes a casing 410 that extends between a first end portion 402 and a second end portion 404, e.g., along the axial direction A. Casing 410 includes various static or non-moving structural components of linear compressor 400. In particular, casing 410 includes a cylinder assembly 411 that defines a chamber 412. Cylinder assembly 411 is positioned at or adjacent second end portion 404 of casing 410. Chamber 412 extends longitudinally along the axial direction A. Casing 410 also includes a motor mount mid-section 413 and an end cap 415 positioned opposite each other about a motor. A stator, e.g., including an outer back iron 450 and a driving coil 452, of the motor is mounted or secured to casing 410, e.g., such that the stator is sandwiched between motor mount mid-section 413 and end cap 415 of casing 410. Linear compressor 400 also includes valves (such as a discharge valve assembly 417 at an end of chamber 412) that permit refrigerant to enter and exit chamber 412 during operation of linear compressor 400.

A piston assembly 414 with a piston head 416 is slidably received within chamber 412 of cylinder assembly 411. In particular, piston assembly 414 is slidable along the axial direction A within chamber 412. During sliding of piston head 416 within chamber 412, piston head 416 compresses refrigerant within chamber 412. As an example, from a top dead center position, piston head 416 can slide within chamber 412 towards a bottom dead center position along the axial direction A, i.e., an expansion stroke of piston head 416. When piston head 416 reaches the bottom dead center position, piston head 416 changes directions and slides in chamber 412 back towards the top dead center position, i.e., a compression stroke of piston head 416. It should be understood that linear compressor 400 may include an additional piston head and/or additional chamber at an opposite end of linear compressor 400. Thus, linear compressor 400 may have multiple piston heads in alternative exemplary embodiments.

As may be seen in FIG. 4, linear compressor 400 also includes an inner back iron assembly 430. Inner back iron assembly 430 is positioned in the stator of the motor. In particular, outer back iron 450 and/or driving coil 452 may extend about inner back iron assembly 430, e.g., along a circumferential direction. Inner back iron assembly 430 also has an outer surface 437. At least one driving magnet 440 is mounted to inner back iron assembly 430, e.g., at outer surface 437 of inner back iron assembly 430. Driving magnet 440 may face and/or be exposed to driving coil 452.

In particular, driving magnet 440 may be spaced apart from driving coil 452, e.g., along the radial direction R by an air gap. Thus, the air gap may be defined between opposing surfaces of driving magnet 440 and driving coil 452. Driving magnet 440 may also be mounted or fixed to inner back iron assembly 430 such that an outer surface of driving magnet 440 is substantially flush with outer surface 437 of inner back iron assembly 430. Thus, driving magnet 440 may be inset within inner back iron assembly 430. In such a manner, the magnetic field from driving coil 452 may have to pass through only a single air gap between outer back iron 450 and inner back iron assembly 430 during operation of linear compressor 400, and linear compressor 400 may be more efficient relative to linear compressors with air gaps on both sides of a driving magnet.

As may be seen in FIG. 4, driving coil 452 extends about inner back iron assembly 430, e.g., along the circumferential direction. Driving coil 452 is operable to move the inner back iron assembly 430 along the axial direction A during operation of driving coil 452. As an example, a current may be induced in driving coil 452 by a current source (not shown) to generate a magnetic field that engages driving magnet 440 and urges piston assembly 414 to move along the axial direction A in order to compress refrigerant within chamber 412 as described above. In particular, the magnetic field of driving coil 452 may engage driving magnet 440 in order to move inner back iron assembly 430 and piston head 416 the axial direction A during operation of driving coil 452. Thus, driving coil 452 may slide piston assembly 414 between the top dead center position and the bottom dead center position during operation of driving coil 452.

Linear compressor 400 may include various components for permitting and/or regulating operation of linear compressor 400. In particular, linear compressor 400 includes a controller (not shown) that is configured for regulating operation of linear compressor 400. The controller is in, e.g., operative, communication with the motor, e.g., driving coil 452 of the motor. Thus, the controller may selectively activate driving coil 452, e.g., by supplying current to driving coil 452, in order to compress refrigerant with piston assembly 414 as described above.

The controller includes memory and one or more processing devices such as microprocessors, CPUs or the like, such as general or special purpose microprocessors operable to execute programming instructions or micro-control code associated with operation of linear compressor 400. The memory can represent random access memory such as DRAM, or read only memory such as ROM or FLASH. The processor executes programming instructions stored in the memory. The memory can be a separate component from the processor or can be included onboard within the processor. Alternatively, the controller may be constructed without using a microprocessor, e.g., using a combination of discrete analog and/or digital logic circuitry (such as switches, amplifiers, integrators, comparators, flip-flops, AND gates, and the like) to perform control functionality instead of relying upon software.

Linear compressor 400 also includes a spring 420. Spring 420 is positioned in inner back iron assembly 430. In particular, inner back iron assembly 430 may extend about spring 420, e.g., along the circumferential direction. Spring 420 also extends between first and second end portions 402 and 404 of casing 410, e.g., along the axial direction A. Spring 420 assists with coupling inner back iron assembly 430 to casing 410, e.g., cylinder assembly 411 of casing 410. In particular, inner back iron assembly 430 is fixed to spring 420 at a middle portion of spring 420 as discussed in greater detail below.

During operation of driving coil 452, spring 420 supports inner back iron assembly 430. In particular, inner back iron assembly 430 is suspended by spring 420 within the stator or the motor of linear compressor 400 such that motion of inner back iron assembly 430 along the radial direction R is hindered or limited while motion along the axial direction A is relatively unimpeded. Thus, spring 420 may be substantially stiffer along the radial direction R than along the axial direction A. In such a manner, spring 420 can assist with maintaining a uniformity of the air gap between driving magnet 440 and driving coil 452, e.g., along the radial direction R, during operation of the motor and movement of inner back iron assembly 430 on the axial direction A. Spring 420 can also assist with hindering side pull forces of the motor from transmitting to piston assembly 414 and being reacted in cylinder assembly 411 as a friction loss.

Inner back iron assembly 430 includes an outer cylinder 436 and a sleeve 439. Outer cylinder 436 defines outer surface 437 of inner back iron assembly 430 and also has an inner surface 438 positioned opposite outer surface 437 of outer cylinder 436. Sleeve 439 is positioned on or at inner surface 438 of outer cylinder 436. A first interference fit between outer cylinder 436 and sleeve 439 may couple or secure outer cylinder 436 and sleeve 439 together. In alternative exemplary embodiments, sleeve 439 may be welded, glued, fastened, or connected via any other suitable mechanism or method to outer cylinder 436.

Sleeve 439 extends about spring 420, e.g., along the circumferential direction. In addition, a middle portion of spring 420 is mounted or fixed to inner back iron assembly 430 with sleeve 439. Sleeve 439 extends between inner surface 438 of outer cylinder 436 and the middle portion of spring 420, e.g., along the radial direction R. A second interference fit between sleeve 439 and the middle portion of spring 420 may couple or secure sleeve 439 and the middle portion of spring 420 together. In alternative exemplary embodiments, sleeve 439 may be welded, glued, fastened, or connected via any other suitable mechanism or method to the middle portion of spring 420.

Outer cylinder 436 may be constructed of or with any suitable material. For example, outer cylinder 436 may be constructed of or with a plurality of (e.g., ferromagnetic) laminations. The laminations are distributed along the circumferential direction in order to form outer cylinder 436 and are mounted to one another or secured together, e.g., with rings pressed onto ends of the laminations. Outer cylinder 436 defines a recess that extends inwardly from outer surface 437 of outer cylinder 436, e.g., along the radial direction R. Driving magnet 440 is positioned in the recess on outer cylinder 436, e.g., such that driving magnet 440 is inset within outer cylinder 436.

A piston flex mount 460 is mounted to and extends through inner back iron assembly 430. In particular, piston flex mount 460 is mounted to inner back iron assembly 430 via sleeve 439 and spring 420. Thus, piston flex mount 460 may be coupled (e.g., threaded) to spring 420 in order to mount or fix piston flex mount 460 to inner back iron assembly 430. A coupling 470 extends between piston flex mount 460 and piston assembly 414, e.g., along the axial direction A. Thus, coupling 470 connects inner back iron assembly 430 and piston assembly 414 such that motion of inner back iron assembly 430, e.g., along the axial direction A, is transferred to piston assembly 414. Coupling 470 may extend through driving coil 452, e.g., along the axial direction A.

Piston flex mount 460 defines at least one suction gas inlet (not shown) at or adjacent first end portion 402 of casing 410. The suction gas inlet of piston flex mount 460 extends, e.g., along the axial direction A, through piston flex mount 460. Thus, a flow of fluid, such as air or refrigerant, may pass through piston flex mount 460 via the suction gas inlet of piston flex mount 460 during operation of linear compressor 400.

Piston head 416 also defines at least one opening 418. Opening 418 of piston head 416 extends, e.g., along the axial direction A, through piston head 416. Thus, the flow of fluid may pass through piston head 416 via opening 418 of piston head 416 into chamber 412 during operation of linear compressor 400. In such a manner, the flow of fluid (that is compressed by piston head 416 within chamber 412) may flow through piston flex mount 460 and inner back iron assembly 430 to piston assembly 414 during operation of linear compressor 400.

Linear compressor 400 also includes features for coupling linear compressor 400 to oil cooling circuit 200 (FIG. 2) or oil cooling circuit 300 (FIG. 3). For example, as shown in FIG. 4, linear compressor 400 includes a pump 480, an outlet conduit 490 and an inlet conduit 492. Pump 480 is positioned at or adjacent a sump 482 of shell 401. Sump 482 corresponds to a portion of shell 401 at or adjacent a bottom of shell 401. Thus, lubricating oil within shell 401 may pool within sump 482, e.g., because the lubricating oil is denser than the refrigerant within shell 401. Pump 480 may draw the lubricating oil from sump 482 to pump 480 via a supply line 484 extending from pump 480 to sump 482.

Pump 480 is also configured for directing or urging the lubricating oil into outlet conduit 490 during operation of pump 480. Outlet conduit 490 may be coupled to supply conduit 222 of oil cooling circuit 200 (FIG. 2) or supply conduit 322 of oil cooling circuit 300 (FIG. 3). Thus, pump 480 may urge lubricating oil from sump 482 into supply conduit 222 or supply conduit 322. In such a manner, pump 480 may supply lubricating oil to one of oil cooling circuit 200 and oil cooling circuit 300 in order to cool the lubricating oil from linear compressor 400, as discussed above.

Inlet conduit 492 may be coupled to return conduit 224 of oil cooling circuit 200 (FIG. 2) or return conduit 324 of oil cooling circuit 300 (FIG. 3). Thus, from heat exchanger 210 or heat exchanger 310, lubricating oil may flow back into linear compressor 400 via inlet conduit 492. As shown in FIG. 4, inlet conduit 492 may extend to cylinder assembly 411. In particular, inlet conduit 492 may extend around chamber 412 of cylinder assembly 411 along the circumferential direction such that inlet conduit 492 defines an annular chamber around chamber 412 of cylinder assembly 411 within cylinder assembly 411. Lubricating oil from inlet conduit 492 may flow from inlet conduit 492 into chamber 412 of cylinder assembly 411 (e.g., via radial conduits) in order to lubricate motion of piston assembly 414 within chamber 412 of cylinder assembly 411.

As discussed above, oil cooling circuit 200 or oil cooling circuit 300 may cool lubricating oil from linear compressor 400. After such cooling, the lubricating oil is returned to linear compressor 400 via inlet conduit 492. Thus, the lubricating oil in inlet conduit 492 may be cooler than lubricating oil in sump 482, and the lubricating oil in inlet conduit 492 may also assist with cooling cylinder assembly 411 during operation of linear compressor 400.

Linear compressor 400 may also include features for cooling the motor of linear compressor 400 during operation of linear compressor 400. For example, linear compressor 400 may include an auxiliary conduit 494 that extends from inlet conduit 492. Thus, auxiliary conduit 494 may be in fluid communication with inlet conduit 492 such that a portion of the lubricating oil within inlet conduit 492 flows into auxiliary conduit 494. An outlet 496 of auxiliary conduit 494 is positioned over the motor of linear compressor 400, e.g., over the outer back iron 450 and/or driving coil 452 of the motor. Lubricating oil from inlet conduit 492 flows through auxiliary conduit 494 to outlet 496 of auxiliary conduit 494 where the lubricating oil flows over the motor of linear compressor 400. In such a manner, the motor of linear compressor 400 may be cooled with lubricating oil, e.g., in order to improve performance of linear compressor 400.

Figure 5:
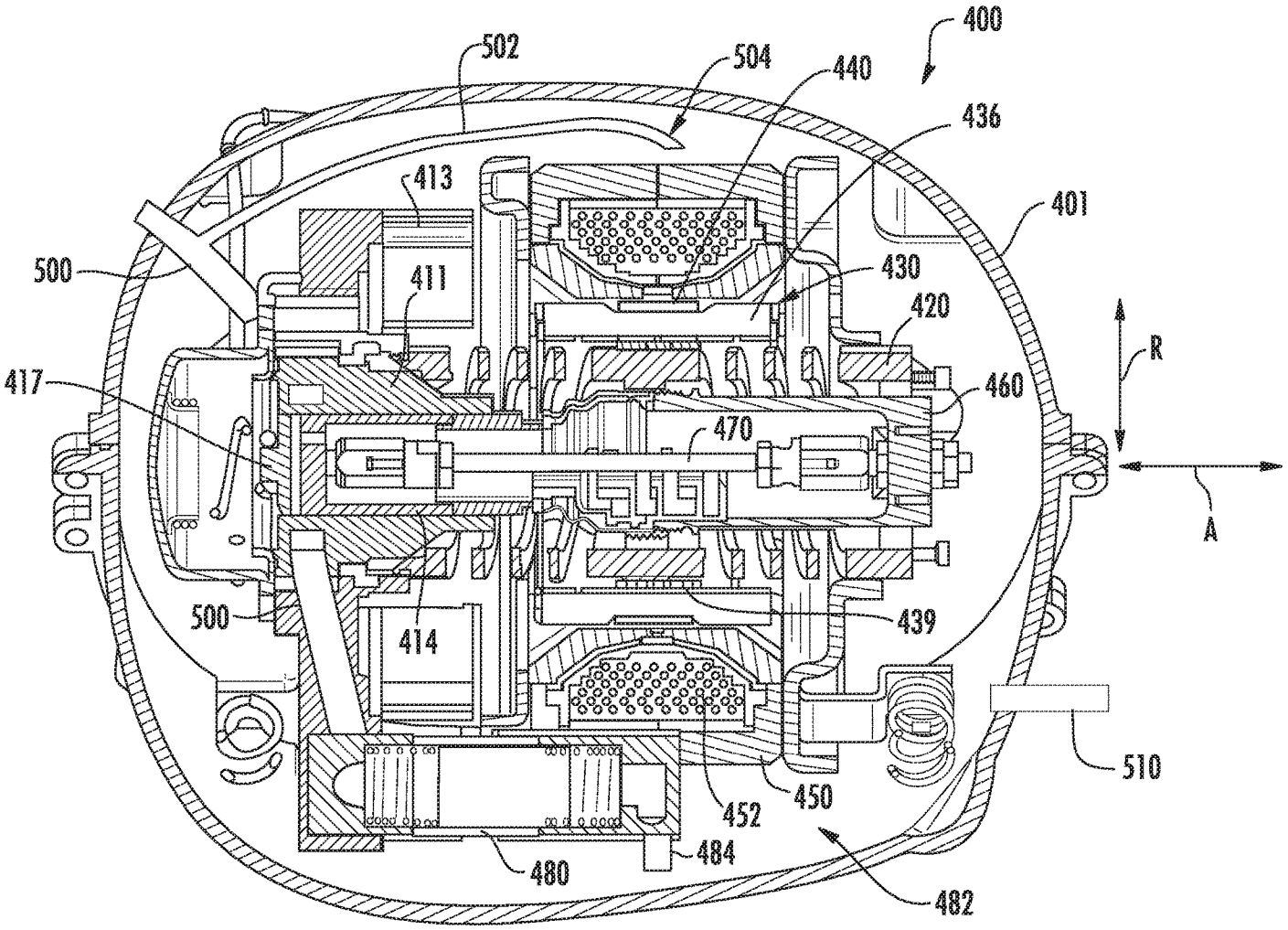
FIG. 5 provides a section view of the exemplary linear compressor of FIG. 4 with an oil flow path according to another exemplary embodiment of the present subject matter.

FIG. 5 provides a section view of linear compressor 400 with an oil flow path according to another exemplary embodiment of the present subject matter. Linear compressor 400 may be constructed with the exemplary oil flow path shown in FIG. 5 rather than the oil flow path shown in FIG. 4 and discussed above. In all other respects, linear compressor 400 and components of linear compressor 400 are identical in FIGS. 4 and 5.

The oil flow path shown in FIG. 5 assists with coupling linear compressor 400 to oil cooling circuit 200 (FIG. 2) or oil cooling circuit 300 (FIG. 3). For example, as shown in FIG. 5, linear compressor 400 includes pump 480, an outlet conduit 500 and an inlet conduit 510.

Pump 480 is configured for directing or urging the lubricating oil into outlet conduit 500 during operation of pump 480. Outlet conduit 500 may be coupled to supply conduit 222 of oil cooling circuit 200 (FIG. 2) or supply conduit 322 of oil cooling circuit 300 (FIG. 3). Thus, pump 480 may urge lubricating oil from sump 482 into supply conduit 222 or supply conduit 322. In such a manner, pump 480 may supply lubricating oil to one of oil cooling circuit 200 and oil cooling circuit 300 in order to cool the lubricating oil from linear compressor 400, as discussed above.

As shown in FIG. 5, outlet conduit 500 may also extend from pump 480 to cylinder assembly 411. In particular, outlet conduit 500 may extend around chamber 412 of cylinder assembly 411 within cylinder assembly 411 along the circumferential direction such that outlet conduit 500 defines an annular chamber around chamber 412 of cylinder assembly 411. Lubricating oil from outlet conduit 500 may flow from outlet conduit 500 into chamber 412 of cylinder assembly 411 (e.g., via radial conduits) in order to lubricate motion of piston assembly 414 within chamber 412 of cylinder assembly 411.

Inlet conduit 510 may be coupled to return conduit 224 of oil cooling circuit 200 (FIG. 2) or return conduit 324 of oil cooling circuit 300 (FIG. 3). Thus, from heat exchanger 210 or heat exchanger 310, lubricating oil may flow back into linear compressor 400 via inlet conduit 510. In addition, inlet conduit 510 may be positioned at or adjacent sump 482. Thus, lubricating oil may flow back into linear compressor 400 at inlet conduit 510 may flow into sump 482. As discussed above, oil cooling circuit 200 or oil cooling circuit 300 may cool lubricating oil from linear compressor 400. After such cooling, the lubricating oil is returned to linear compressor 400 via inlet conduit 510. Thus, the lubricating oil in inlet conduit 510 may be relatively cool and assist with cooling lubricating oil in sump 482.

Linear compressor 400 may also include features for cooling the motor of linear compressor 400 during operation of linear compressor 400. For example, linear compressor 400 may include an auxiliary conduit 502 that extends from outlet conduit 500. Thus, auxiliary conduit 502 may be in fluid communication with outlet conduit 500 such that a portion of the lubricating oil within outlet conduit 500 flows into auxiliary conduit 502. An outlet 504 of auxiliary conduit 502 is positioned over the motor of linear compressor 400, e.g., over the outer back iron 450 and/or driving coil 452 of the motor. Lubricating oil from outlet conduit 500 flows through auxiliary conduit 502 to outlet 504 of auxiliary conduit 502 where the lubricating oil flows over the motor of linear compressor 400. In such a manner, the motor of linear compressor 400 may be cooled with lubricating oil, e.g., in order to improve performance of linear compressor 400.

While described above in the context of linear compressor 400, it should be understood that the present subject matter may be used in or with any suitable linear compressor in alternative exemplary embodiments. For example, the oil flow paths shown in FIGS. 4 and 5 may be provided or formed in the linear compressor described in U.S. Patent Publication No. 2015/0226197A1 of Gregory William Hahn et al., filed on Feb. 10, 2014, which is hereby incorporated by reference in its entirety for all purposes. Thus, the oil flow paths described herein may be used in and/or formed in linear compressors with planar springs in certain exemplary embodiments.

Turning now to FIG. 6, an oil cooling circuit 600 according to an exemplary embodiment of the present subject matter is shown with refrigeration system 60. Oil cooling circuit 600 may assist with rejecting heat from the lubrication oil in refrigeration system 60. Oil cooling circuit 600 includes a heat exchanger 610 and a refrigerant conduit 620. In contrast to oil cooling circuit 200 (FIG. 2) and oil cooling circuit 300 (FIG. 3), oil cooling circuit 600 does not remove lubricating oil from compressor 64. Rather, oil cooling circuit 600 removes refrigerant from condenser 66 and directs such refrigerant to compressor 64 to cool the lubricating oil in compressor 64, as discussed in greater detail below.

Refrigerant conduit 620 extends between condenser 66 and heat exchanger 610. Refrigerant from condenser 66 may flow to heat exchanger 610 via refrigerant conduit 620. As shown in FIG. 6, refrigerant conduit 620 may include a supply conduit 622 and a return conduit 624. Supply conduit 622 extends between condenser 66 and heat exchanger 610 and is configured for directing refrigerant from condenser 66 to heat exchanger 610. Conversely, return conduit 624 extends between heat exchanger 610 and condenser 66 and is configured for directing refrigerant from heat exchanger 610 to condenser 66.

Heat exchanger 610 is positioned on or in compressor 64. As an example, heat exchanger 610 may be positioned or disposed on shell 401 or within shell 401 at sump 482 of shell 401 (FIG. 4). Thus, the lubrication oil in compressor 64 may reject heat to refrigerant within heat exchanger 610. From heat exchanger 610, the refrigerant flows back to condenser 66 via refrigerant conduit 620. In such a manner, refrigerant conduit 620 may circulate refrigerant between condenser 66 and heat exchanger 610, and heat exchanger 610 may reduce the temperature of lubricating oil in compressor 64 before returning the refrigerant to condenser 66. Thus, oil cooling circuit 600 may remove refrigerant from condenser 66 via refrigerant conduit 620 and return the refrigerant to condenser 66 via refrigerant conduit 620 after cooling the lubricating oil in compressor 64.

Oil cooling circuit 600 may remove refrigerant from a middle portion of condenser 66 between an inlet and an outlet of condenser 66. For example, refrigerant may enter condenser 66 at the inlet of condenser 66 at a first temperature (e.g., one hundred and fifty degrees Fahrenheit (150° F.)), and supply conduit 622 may be positioned on condenser 66 downstream of the inlet of condenser 66 such that refrigerant immediately upstream of the portion of condenser 66 where supply conduit 622 is mounted may have a second temperature (e.g., ninety degrees Fahrenheit (90° F.)). Conversely, return conduit 624 may also be positioned on condenser 66 upstream of the outlet of condenser 66 such that refrigerant immediately downstream of the portion of condenser 66 where return conduit 624 is mounted may have a third temperature (e.g., one hundred and five degrees Fahrenheit (105° F.)), and refrigerant may exit condenser 66 at the outlet of condenser 66 at a fourth temperature (e.g., ninety degrees Fahrenheit (90° F.)). Thus, condenser 66 may be configured for rejected heat from the lubrication oil within compressor 64 to ambient air about condenser 66 after the refrigerant returns to condenser 66 via return conduit 624.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A scaled system for an appliance, comprising:

a compressor comprising a shell and a lubrication oil disposed with the shell;

a condenser in fluid communication with the compressor such that compressed refrigerant from the compressor flows to the condenser during operation of the compressor;

a condenser fan configured for selectively urging a flow of air across the condenser; and a heat exchanger positioned adjacent the condenser fan, the heat exchanger being in fluid communication with the compressor such that lubrication oil from the compressor flows to the heat exchanger during operation of the compressor.

2. The sealed system of claim 1, further comprising a refrigeration conduit that extends between the compressor and the condenser and a lubrication oil conduit that extends between the compressor and the heat exchanger, the refrigeration conduit directing compressed refrigerant from the compressor to the condenser during operation of the compressor, lubrication oil conduit directing lubrication oil from the compressor to the heat exchanger during operation of the compressor.

3. The sealed system of claim 1, wherein the compressor further comprises a pump, the pump operable to urge a flow of lubrication oil from the compressor to the heat exchanger during operation of the compressor.

4. The sealed system of claim 1, wherein the compressor further comprises a pump, the shell of the compressor comprising an inlet conduit and an outlet conduit, the pump coupled to the outlet conduit such that the pump is operable to urge a flow of lubrication oil from the compressor to the heat exchanger via the outlet conduit, the inlet conduit configured for receiving the flow of lubrication oil from the heat exchanger, the inlet conduit extending to a cylinder of the compressor to direct the flow of lubrication oil from the beat exchanger to the cylinder.

5. The sealed system of claim 4, wherein the inlet conduit defines an auxiliary outlet disposed above a motor of the compressor.

6. The sealed system of claim 1, wherein the compressor further comprises a pump, the shell of the compressor comprising an inlet conduit and an outlet conduit, the pump in fluid communication with the inlet conduit and the outlet conduit, the inlet conduit configured for receiving the flow of lubrication oil from the heat exchanger and directing the flow of lubrication oil from the heat exchanger into a sump of the shell, the outlet conduit extending from a cylinder of the compressor to direct the flow of lubrication oil from cylinder to the heat exchanger.

7. The sealed system of claim 6, further comprising an auxiliary conduit extending from the pump and having an outlet disposed above a motor of the compressor.

8. The sealed system of claim 1, wherein the heat exchanger is configured for cooling the lubrication oil from the compressor during operation of the compressor.

9. The scaled system of claim 1, wherein the heat exchanger is positioned such that the condenser fan urges air across the heat exchanger during operation of the condenser fan.

* * * * *